United States Patent [19]

Sittmann

[11] 3,942,809

[45] Mar. 9, 1976

[54] SAFETY SKI BINDING

[75] Inventor: Brigitte Sittmann, Stuttgart, Germany

[73] Assignee: Vereinigte Baubeschlagfabriken Gretsch & Co. GmbH, Germany

[22] Filed: Oct. 23, 1973

[21] Appl. No.: 408,741

[30] Foreign Application Priority Data

Oct. 21, 1972 Germany ..... 2251775

[52] U.S. Cl. .....280/11.35 R; 280/11.35 C; 280/11.35 K; 280/11.35 Y

[51] Int. Cl.[2] ..... A63C 9/08

[58] Field of Search ..... 280/11.35 D, 11.35 E, 280/11.35 K, 11.35 C, 11.35 R, 11.35 A, 11.35 Y

[56] References Cited

UNITED STATES PATENTS

| | | | |
|---|---|---|---|
| 3,771,806 | 11/1973 | Hinterholzer et al. | 280/11.35 K |
| 3,781,028 | 12/1973 | Gertsch et al. | 280/11.35 K |
| 3,785,668 | 1/1974 | Marker | 280/11.35 R |
| 3,825,273 | 7/1974 | Greene | 280/11.35 K |
| 3,838,866 | 10/1974 | D'Alessio et al. | 280/11.35 K |

FOREIGN PATENTS OR APPLICATIONS

| | | | |
|---|---|---|---|
| 1,337,872 | 8/1963 | France | 280/11.35 K |
| 268,189 | 8/1950 | Switzerland | 280/11.35 K |
| 2,030,749 | 12/1971 | Germany | |
| 2,210,338 | 9/1972 | Germany | |

*Primary Examiner*—Philip Goodman
*Assistant Examiner*—Milton L. Smith
*Attorney, Agent, or Firm*—Craig & Antonelli

[57] ABSTRACT

A safety ski binding with a release mechanism that normally retains the ski boot against a resistance; when exceeding this resistance, the release mechanism permits a rotation of the boot about an axis of rotation forwardly by an amount sufficient for the release of the boot; the axis of rotation is a cross-axis arranged between the toe and heel area as well as between the running surface of the ski and the knee joint and the rotary movement of the boot starts with a predetermined torque in relation to this cross axis which corresponds to a bending moment that is just barely still tolerable by the lower part of the leg.

30 Claims, 5 Drawing Figures

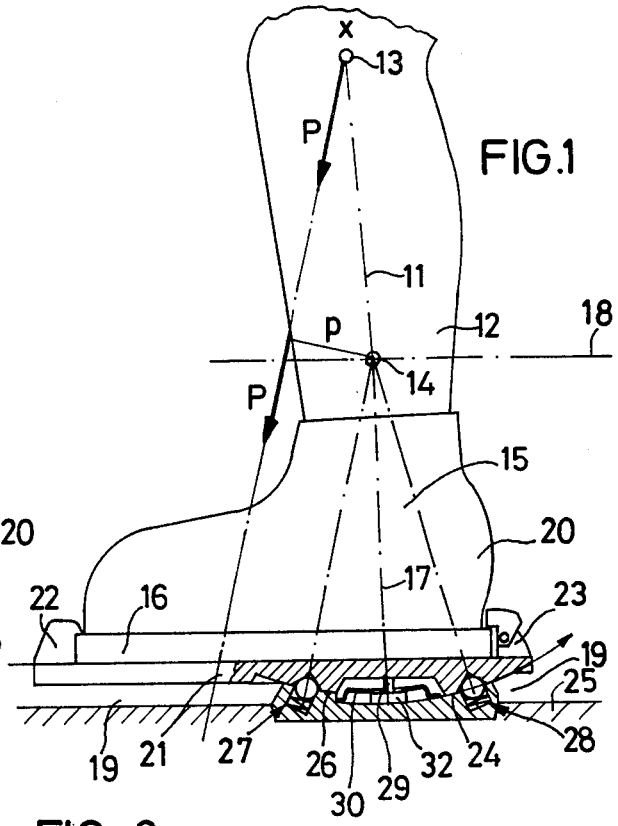
FIG.1
FIG.2
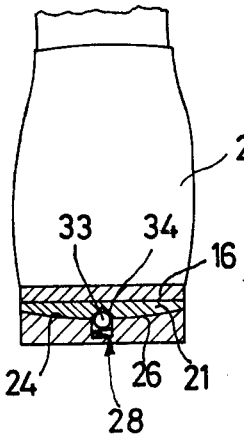
FIG. 3
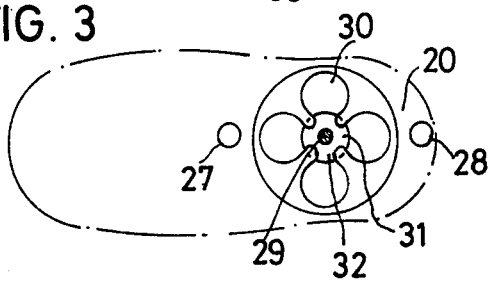

SAFETY SKI BINDING

The present invention relates to a safety ski binding with a release mechanism holding the ski boot directly or indirectly against a resistance, which upon overcoming this resistance, permits a rotation of the boot about an axis of rotation in the forward direction by an amount sufficient for the release of the boot.

Known release safety ski bindings of this type function completely satisfactorily, if, in case of essentially forwardly acting forces in the knee joint relative to the ski, the extension of the vector of the resultant resulting from gravity and acceleration intersects the ski longitudinal axis sufficiently far in front of the boot tip, whereby one has to assume that the cross axis, about which the ski boot rotates during the release, lies within the area of the boot tip, i.e., within the area of the forward holding mechanism.

The present invention starts with the recognition that particularly dangerous fractures of the lower part of the leg, i.e., of the shank, may occur if the resultant force engaging in the knee joint which results from gravity and acceleration forces, points toward areas shortly in front or to the rear of the forward boot holding or retaining mechanism. In those cases, the conventional release ski bindings cannot respond whereas, on the other hand, notwithstanding the considerable force components in the direction of the neutral axis of the lower leg part, such considerable bending moments occur at the lower leg part that frequently very dangerous fractures result.

The aim of the present invention therefore consists in providing a safety ski binding of the aforementioned type which still releases without the danger of a fracture of the lower part of the leg or of the ankle also when the extension of the resultant of gravity and acceleration force intersects the ski longitudinal axis within the area of the boot tip or therebehind.

The underlying problems are solved according to the present invention in that the boot is rotatably supported for movement in the forward direction (movement corresponding to a forward fall) by the amount sufficient for the release of the boot about a cross axis arranged between toe- and heel-area as well as between ski running surface and knee joint in response to a predetermined torque in relation to this cross axis which corresponds to a bending moment just barely still tolerable for the lower part of the leg. The cross axis should preferably extend essentially through the neutral axis of the lower part of the leg or through the rectilinear extension thereof in the downward direction. By reason of this construction, practically every resultant force engaging in the knee joint which does not have the direction of the neutral axis and thus produces a torque about the cross axis, is able to produce a release of the ski binding. Only in the case that, for example, when skiing over a bump, the resultant of gravity and acceleration force lies precisely in the neutral axis, a release cannot take place. This case, however, is not critical because the buckling strength of the lower leg bone is considerably greater in contrast to its bending strength. However, as soon as a dangerous bending moment occurs at the lower leg part by reason of a deviation of the aforementioned resultant force from the direction of the neutral axis, a release of the boot takes place when the extension of the resultant intersects the ski longitudinal axis between the base point of the neutral axis and the forward holding or retaining mechanism. Insofar as this extension intersects the ski longitudinal axis considerably in front of the forward holding mechanism, no problems exist as regards a timely release because the lever arm between the effective line of the resultant force in the knee joint and the cross axis thereby becomes ever larger.

It is particularly advantageous if the cross axis is located approximately at that place of the lower part of the leg at which the quotient or ratio (the bending stress) of the bending moment to the resistance moment of the lower part of the leg has a maximum. More particularly, this area represents the weakest and therefore the most endangered point of the lower leg so that an optimum adaptation to the existing anatomic conditions is assured by the aforementioned location of the cross axis.

However, it is sufficient for practical purposes if the cross axis lies above the ankle approximately by one-third the distance between the ankle and the knee joint or within the area of the boot edge height.

One embodiment of this invention which can be realized in practice in a particularly simple manner is characterized in that the cross axis is disposed within the area of the boot sole. By the use of this construction in particular conventional ski bindings can be converted into release ski safety bindings according to the present invention with relatively slight structural expenditures.

It is particularly appropriate if the boot is also rotatable about a vertical axis by an amount sufficient for the release of the boot, beginning with a predetermined torque which corresponds to a just barely still tolerable torsion moment for the lower part of the leg. With this type of construction, a conventional side release, known as such, can also still take place.

In order to obtain a release also in the case of a lateral fall of the skier, of the so-called tipping over or tilting fall, a further embodiment of the present invention provides that the boot is also rotatable about a longitudinal axis by an amount sufficient for the release of the boot, starting with a predetermined torque which corresponds to a just barely still tolerable bending moment for the lower part of the leg.

A first practical embodiment of this invention is characterized in that the boot sole or a sole plate arranged therebelow is provided with a sliding surface cut out of a circular cylinder, whose cylinder axis coincides with the axis of rotation and cooperates with a complementary sliding surface, for example, secured to the ski where means are provided for holding together the sliding surfaces which are slidable with respect to one another about the cross axis, and a detent mechanism is provided between the slide surfaces which determines the predetermined torque about the cross axis. This embodiment may be appropriately further developed in that the sliding surfaces are curved spherically or at least about two axes so that, in addition to the release in the forward direction, also a lateral release about the vertical axis and/or a tilting release about the ski longitudinal axis are possible.

In a further practical embodiment of the present invention, the ski boot sole or a sole plate arranged therebelow is so suspended forwardly and rearwardly on guide members which are connected with the ski about cross axes, that the boot is able to carry out a limited rotary movement about the cross axis while a detent mechanism determines the predetermined torque about the cross axis.

According to a still further embodiment of the present invention, the boot sole or a sole plate disposed therebelow rests on a projection rounded off at the top and fixed on the ski, whose line- or point-shaped area in contact with the boot sole or the boot plate, determines the cross axis and possibly the vertical and longitudinal axes, and holding or retaining mechanisms are provided within the toe and/or heel areas, of which at least one holding or retaining mechanism is adjusted corresponding to the predetermined torques about the axis of rotation and possibly about the vertical and longitudinal axes. This embodiment is particularly suitable for use in conjunction with conventional holding devices and requires only a slight expenditure in order to realize a release ski binding according to the present invention. The projection may have within the area of the cross axis essentially the shape of a cylindrical surface with a transversely disposed axis or may be constructed as spherical dome-shaped member.

The safety ski binding according to the present invention inclusive the practical embodiments described hereinabove may be further developed in a simple manner to provide a response in case of a rearward fall in that the boot is rotatably supported in the rearward direction about the same cross axis by an amount sufficient for the release of the boot, starting with a predetermined torque in relation to this cross axis which corresponds to a just barely still tolerable bending moment for the lower part of the leg.

These and other objects, features and advantages of the present invention will become more apparent from the following description when taken in connection with the accompanying drawing which shows, for purposes of illustration only, several embodiments in accordance with the present invention, and wherein:

FIG. 1 is a schematic side elevational view, partly in cross section, of one embodiment of a safety ski binding in accordance with the present invention, illustrating the principle according to the present invention, with the ski boot fastened in the ski binding, and also the lower part of the leg of a skier is illustrated;

FIG. 2 is a rear elevational view, partly in cross section, of the safety ski binding of FIG. 1;

FIG. 3 is a schematic plan view of the ski boot according to FIG. 1, whereby additionally the detent mechanisms are indicated;

Figure 4:
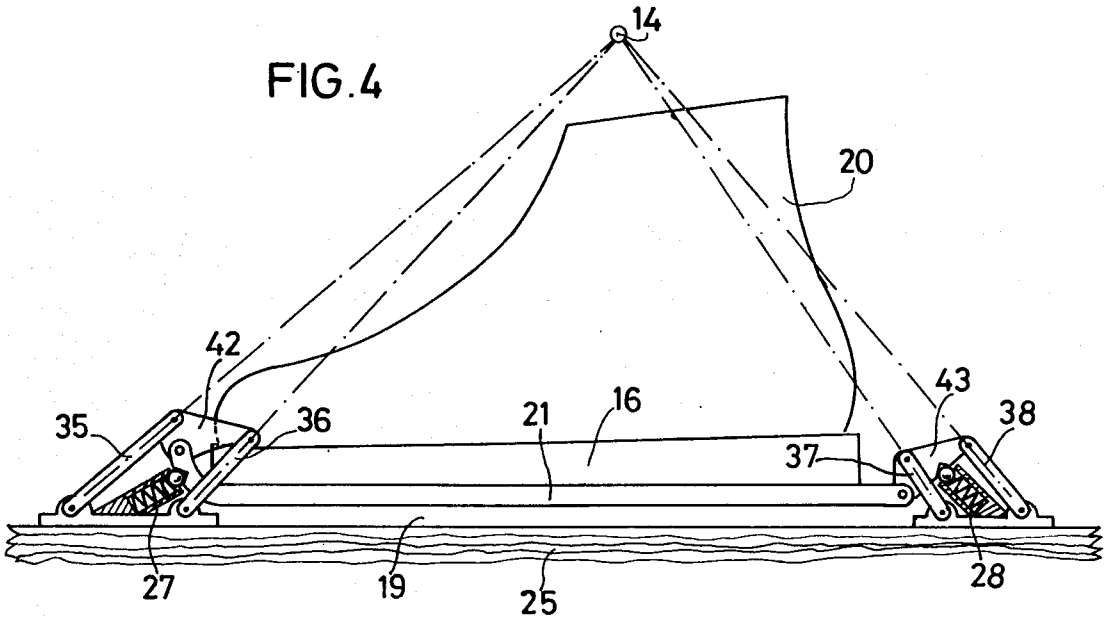
FIG. 4 is a schematic side elevational view of a further advantageous embodiment of a safety ski binding in accordance with the present invention.

Referring now to the drawing wherein like reference numerals are used throughout the various views to designate like parts, and more particularly to FIGS. 1 to 3, the sole 16 of a ski boot 20 is secured according to these figures, on a sole plate 21 by means of a forward holding or retaining mechanism 22 and a rear holding or retaining mechanism 23 of any conventional construction. A spherical slide surface 26 is formed on the bottom side of the sole plate 21 which cooperates with a slide surface 24, for example, complementary with respect thereto which is secured on the ski 25.

The center point of the slide surfaces 24 and 26 is located at 14. The slide surfaces 24 and 26 thus enable a limited rotary movement of the boot 20 about a cross axis 14 disposed perpendicularly to the plane of the drawing in FIG. 1, about the vertical axis 17 and about the longitudinal axis 18. In order that the boot 20 can carry out the pivot movements about the cross axis 14 and the longitudinal axis 18, a free space 19 is left between the sole plate 21 and the surface of the ski 25.

In order that the ski boot comes free of the ski by a predetermined amount during rotary movements, for example, a pin 29 with an enlarged head 32 may be provided on the bottom side of the sole plate 21, whereby the pin 29 and head 32 operate within a guide means 30, for example, in the form of a template mounted on the lower slide surface 26 in such a manner that in the normal position illustrated in the drawing, the two slide surfaces 24 and 26 are held fast in the sliding seat one over the other. However, as soon as the head 32 moves forwardly, rearwardly or toward the side so far that it comes into alignment with the enlarged guide surface areas, i.e., with the enlarged template openings, the two slide surfaces can disengage from one another and a release of the boot takes place.

Thus, the guide surfaces taper up to a slot 31, through which the pin 29 is just able to slide through.

The embodiment according to FIGS. 1 to 3 illustrates only one possibility for the release of the ski boot from the ski. According to a further preferred embodiment, a predetermined relative movement between the slide surfaces 24 and 26 brings about a release of the ski-binding parts, for example, of the heel ski-binding 23 by way of a hydraulic, pneumatic, electrical or mechanical connection (not shown) of any known conventional type so that exclusively the ski boot is released without the sole plate. For the sake of simplicity the details of such known connections are not illustrated herein.

In order to assure that the ski boot together with the sole plate is held fast in the normal position, detent mechanisms 27 and 28 are provided is the lower slide surface 26 consisting, for example, of balls 33, and detent recesses 34 in the counter-surface 24, which assure that the rotary movement about the axes 14, 17 and 18 are released only starting with the predetermined torques which are still without danger for the lower part of the leg.

According to FIG. 1, the cross axis 14 is arranged above the ankle 15 by about one-third the distance from the knee joint 13 to the ankle 15. This location is particularly preferred because the lower leg 12 is weakest within this area. Additionally, the cross axis 14 lies on the neutral axis 11 of the lower part of the leg 12.

An assumed force P is also schematically indicated in FIG. 1, which engages in the knee joint 13 and has to be thought of as the resultant of the gravity and of an accelerating force. The extension of the force vector P intersects the ski longitudinal axis between the base point of the neutral axis 11 and the forward holding mechanism 22. A conventional ski binding would not release in this case. Since, however, the cross axis 14 is disposed according to the present invention at the location illustrated in FIG. 1, the obliquely downwardly directed force P produces a torque about the cross axis 14 by reason of the lever arm $p$, which with an appropriate adjustment of the detent mechanisms 27 and 28 can serve for the release of the ski binding according to the present invention. Consequently, a release takes place notwithstanding the nearly vertically downwardly directed resultant of the forces engaging in the knee joint.

A release may also take place in an analogous manner in case of a torque about the longitudinal axis 18. If a release of the boot is also to take place in case of a rotation about the upright axis 17, the head 32 may be so constructed that it is able to come free of the guide means 30 in case of a certain rotation of the boot about its vertical axis 17.

In the embodiment according to FIG. 4, a sole plate 21 is pivotally connected forwardly and rearwardly thereof on the ski 25 about cross axes by means of two guide members 35, 36 and 37, 38 each. The extensions of the guide members 35, 36, 37, 38 intersect approximately in a point and form the cross axis 14. The upper ends of the guide members 35, 36 and 37, 38 are each pivotally connected to a respective coupler 42 and 43 which, in turn, is pivotally mounted on the sole plate 21. As a result of this construction, the sole plate 21 and therewith the boot 20 carries out a limited rotary movement about the cross axis 14. Schematically indicated detent mechanisms 27 and 28 hold the sole plate 21 fast in the normal position about the cross axis 14 until reaching the critical torque.

The embodiment according to FIG. 4 illustrates only one solution in case of excessive torques about the cross axis 14. The means for the release of the boot 20 in case of a disengagement of the detent mechanisms 27 and 28 as well as release mechanisms which enable releases during movements and/or moments about other axes are not illustrated herein for the sake of simplicity since they are of conventional construction.

Figure 5:
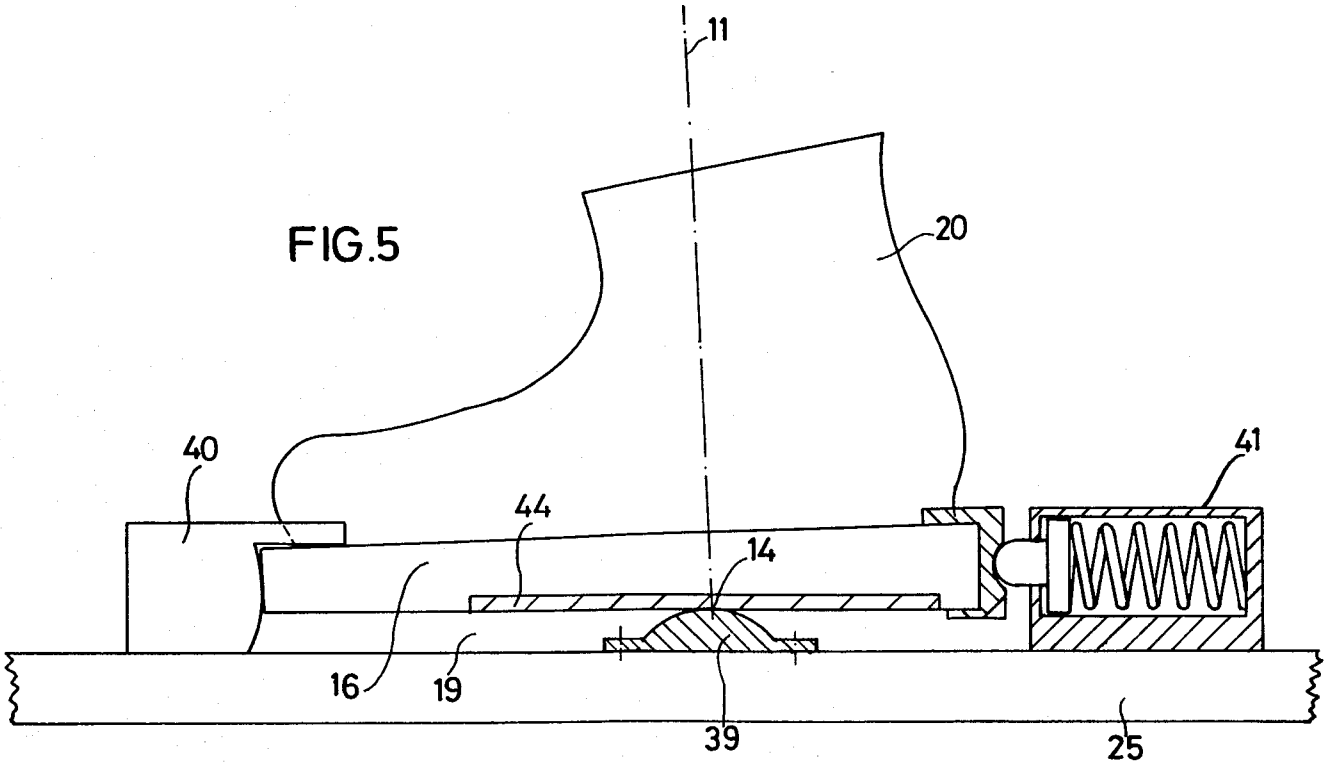
FIG. 5 is a schematic side elevational view, partly in cross section, of a still further modified embodiment of a safety ski binding according to the present invention.

In the embodiment according to FIG. 5, the ski boot 20 is inserted into conventional holding or retaining mechanisms 40 and 41. A reinforcing plate 44 is inserted into its sole, by means of which it rests on a projection 39 fixed to the ski. The free space 19 again exists in front of and to the rear of the projection 39 which permits limited pivot movements of the boot 20.

In the embodiment according to FIG. 5, the cross axis 14, about which the boot is able to rotate is disposed in the top point or apex of the projection 39, which may also be constructed as knife-edge or pivot bearing.

The forward holding mechanism 40 and the rear holding mechanism 41 are so adjusted in conjunction with the location of the cross axis 14 below the neutral axis 11 that with the occurrence of the critical moment about the cross axis 14, a release of the rear holding mechanisms 41 takes place. The critical torsional moment is determined in an analogous manner by the holding mechanisms 40 and 41. A tilting release about the longitudinal axis and a rear fall release is possible in the embodiment illustrated in FIG. 5 if the forward holding mechanism permits the boot sole to pivot away in the upward direction by the use of any known means.

Also all other embodiments may be so constructed that they will respond in case of a rearward fall.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What we claim is:

1. A safety ski binding which comprises a release means retaining a ski boot against a resistance, comprising means rotatably supporting the boot for movement by an amount sufficient for the release of the boot about a cross axis arranged intermediate the ball and heel area of the boot and intermediate the running surface of the ski and the knee joint of the skier, said release means releasing in response to a predetermined torque in relation to said cross axis which torque corresponds to a just barely still tolerable bending moment tolerable by the lower leg of the skier, said cross axis being vertically spaced above the sole of the boot when said boot is in a clamped position on a ski.

2. A safety ski binding according to claim 1, wherein the release means holds the boot indirectly against the resistance.

3. A safety ski binding according to claim 1, wherein the release means holds the boot directly against the resistance.

4. A safety ski binding according to claim 1, wherein the cross axis extends essentially through the neutral axis of the lower leg.

5. A safety ski binding according to claim 1, wherein the cross axis is located within the area of the upper boot edge height.

6. A safety ski binding according to claim 1, wherein the boot is rotatable by an amount sufficient for the release of the boot also about an upright axis in response to a predetermined torque which corresponds to a torsional moment just barely still tolerable for the lower leg.

7. A safety ski binding according to claim 6, wherein the boot is rotatable by an amount sufficient for the release of the boot also about a longitudinal axis in response to a predetermined torque which corresponds to a bending moment just barely still tolerable for the lower leg.

8. A safety ski binding according to claim 7, wherein the cross axis extends essentially through the neutral axis of the lower leg.

9. A safety ski binding according to claim 7, wherein the cross axis is located approximately at that place of the lower leg at which the ratio of the bending moment to resistance moment of the lower leg has a maximum.

10. A safety ski binding according to claim 7, wherein the cross axis lies above the ankle approximately one-third the distance between the ankle and the knee joint.

11. A safety ski binding according to claim 7, wherein the cross axis is located within the area of the upper boot edge height.

12. A safety ski binding according to claim 1, wherein at least one of the two parts consisting of a boot sole and a sole plate arranged therebelow is so suspended forwardly and rearwardly thereof at guide means pivotally connected with the ski about cross axes, that the boot is able to carry out a limited rotary movement about said cross axis, and in that detent means are provided in the ski binding for determining the predetermined torque about the cross axis.

13. A safety ski binding according to claim 1, wherein the boot is rotatable by an amount sufficient for the release of the boot also about a longitudinal axis in response to a predetermined torque which corresponds to a bending moment just barely still tolerable for the lower leg.

14. A safety ski binding according to claim 1, wherein the boot is rotatably supported for movement by an amount in the rearward direction sufficient for the release of the boot about said cross axis in response to a predetermined torque in relation to said cross axis which corresponds to the bending moment just barely still tolerable for the lower leg.

15. A safety ski binding according to claim 1, wherein said cross-axis lies intermediate the height of the ankle and the knee joint of a skier when said skiers leg is in a substantially vertical position with respect to said ski.

16. A safety ski binding which comprises a release means retaining a ski boot against a resistance, comprising means rotatably supporting the boot for movement by an amount sufficient for the release of the boot about a cross axis arranged intermediate the toe and heel area of the boot and intermediate the running surface of the ski and the knee joint of the skier, said release means releasing in response to a predetermined torque in relation to said cross axis which torque corresponds to a just barely still tolerable bending moment tolerable by the lower leg of the skier, wherein the cross axis is located approximately at that place of the lower leg at which the ratio of the bending moment to resistance moment of the lower leg has a maximum.

17. A safety ski binding which comprises a release means retaining a ski boot against a resistance, comprising means rotatably supporting the boot for movement by an amount sufficient for the release of the boot about a cross axis arranged intermediate the toe and heel area of the boot and intermediate the running surface of the ski and the knee joint of the skier, said release means releasing in response to a predetermined torque in relation to said cross axis which torque corresponds to a just barely still tolerable bending moment tolerable by the lower leg of the skier, wherein the cross axis lies above the ankle approximately one-third the distance between the ankle and the knee joint.

18. A safety ski binding which comprises a release means retaining a ski boot against a resistance, comprising means rotatably supporting the boot for movement by an amount sufficient for the release of the boot about a cross axis arranged intermediate the toe and heel area of the boot and intermediate the running surface of the ski and the knee joint of the skier, said release means releasing in response to a predetermined torque in relation to said cross axis which torque corresponds to a just barely still tolerable bending moment tolerable by the lower leg of the skier, wherein one of the two parts consisting of a boot sole or a sole plate arranged therebelow is provided with a slide surface means of substantially circular cylindrical shape, whose cylinder axis essentially coincides with the cross axis and which cooperates with a slide surface means fixed on the ski, further means being provided for holding together the slide surface means slidable with respect to one another about the cross axis, and detent means being provided between the slide surface means which determine the predetermined torque about the cross axis.

19. A safety ski binding according to claim 18, wherein the slide surface means are substantially spherically shaped.

20. A safety ski binding according to claim 18, wherein said slide surface means are curved at least about two axes.

21. A safety ski binding comprising:

a ski boot retaining means for normally retaining a ski boot in an in-use skiing position on a ski, and release means for releasing said boot from said ski in response to predetermined forces acting on said ski boot, wherein said release means includes means for guiding and supporting the boot for rotational movement along a predetermined path about a cross-axis from said in-use position to a release position which is rotatably spaced from said in-use position, and wherein said cross-axis extends transverse to the longitudinal direction of said ski and is disposed intermediate the heel and ball area of said ski boot, said cross axis being vertically spaced above the sole of the boot when said boot is in a clamped position on a ski.

22. A safety ski binding according to claim 21, wherein said cross-axis is disposed intermediate the running surface of the ski and the position of the knee joint of a skier using said bindings when said skiers leg is in a substantially vertical position with respect to said ski.

23. A safety ski binding according to claim 22, wherein said means for guiding and supporting includes mated relatively slideable curvilinear surfaces having said cross-axis as the axis of curvature thereof.

24. A safety ski binding according to claim 22, wherein said means for guiding and supporting includes means for maintaining said cross-axis in a relatively fixed position with respect to said ski during movement of said ski boot from said in-use to said release position.

25. A safety ski binding according to claim 22, wherein said retaining means includes a sole plate separate from said ski and hold-down means for holding said ski boot to said sole plate, and wherein said release means includes means for releasably holding said sole plate to said ski.

26. A safety ski binding according to claim 21, wherein said means for guiding and supporting includes means for maintaining said cross-axis in a relatively fixed position with respect to said ski during movement of said ski boot from said in-use to said release position.

27. A safety ski binding according to claim 21, wherein said retaining means includes a sole plate separate from said ski and hold-down means for holding said ski boot to said sole plate, and wherein said release means includes means for releasably holding said sole plate to said ski.

28. A safety ski binding according to claim 21, wherein said cross-axis lies intermediate the height of the ankle and the knee joint of a skier when said skiers leg is in a substantially vertical position with respect to said ski.

29. A safety ski binding comprising:

a ski boot retaining means for normally retaining a ski boot in an in-use skiing position on a ski, and release means for releasing said boot from said ski in response to predetermined forces acting on said ski boot, wherein said release means includes means for guiding and supporting the boot for rotational movement along a predetermined path about a cross-axis from said in-use position to a release position which is rotatably spaced from said in-use position, wherein said cross-axis extends transverse to the longitudinal direction of said ski and is disposed intermediate the heel and ball area of said ski boot, and wherein said means for guiding and supporting includes mated relatively slideable curvilinear surfaces having said cross-axis as the axis of curvature thereof.

30. A safety ski binding according to claim 29, wherein said means for guiding and supporting includes means for maintaining said cross-axis in a relatively fixed position with respect to said ski during movement of said ski boot from said in-use to said release position.

* * * * *